United States Patent [19]

Brent

[11] 4,310,111

[45] Jan. 12, 1982

[54] DEVICES FOR THE SUPPORT OF STRINGED MUSICAL INSTRUMENTS

[76] Inventor: Rachael E. Brent, P.O. Box 884, San Bruno, Calif. 94066

[21] Appl. No.: 51,638

[22] Filed: Jun. 25, 1979

[51] Int. Cl.[3] ..... G10D 3/00

[52] U.S. Cl. ..... 224/252; 224/211; 224/910

[58] Field of Search ..... 224/211, 222, 252, 256, 224/269–272, 910; 84/278, 280 R, 280 C

[56] References Cited

U.S. PATENT DOCUMENTS

| | | | |
|---|---|---|---|
| 1,802,236 | 4/1931 | Carroll et al. | 84/327 |
| 1,817,223 | 8/1932 | Reese | 224/208 X |
| 2,372,971 | 4/1945 | Moore | 224/208 X |
| 2,652,739 | 9/1953 | Hall | 84/280 R |
| 3,037,416 | 6/1962 | Cunningham | 84/267 |
| 3,371,570 | 3/1968 | Lester | 84/327 |
| 3,372,614 | 3/1968 | Galster | 84/280 R |
| 3,727,509 | 4/1973 | Henkle | 84/280 R |
| 3,743,147 | 7/1973 | Wilczynski | 224/271 X |
| 4,121,743 | 10/1978 | Burton | 224/271 |

*Primary Examiner*—Stephen Marcus
*Attorney, Agent, or Firm*—John L. McGannon

[57] ABSTRACT

The present invention relates to improvements in the support of stringed musical instruments consisting of a specially designed belt, and means of attaching the belt to the instrument.

8 Claims, 11 Drawing Figures

DEVICES FOR THE SUPPORT OF STRINGED MUSICAL INSTRUMENTS

BRIEF DESCRIPTION OF THE INVENTION

The primary object of this invention is to supply the musician with practical means of supporting his guitar, bass, or other musical instrument, permitting him to abandon the traditional strap-type support which concentrates the weight of the instrument upon the shoulder and back of the player.

This invention consists of two seperate components; a support belt to be worn by the player, and a support plate to be attached directly to the instrument.

The support belt is worn around the player's waist or hips. The exact placement of the belt depends upon the level at which the musician desires his instrument. The belt is held secure by the use of an extension which runs along the inside of one of the player's legs. This extension also aids in distributing the weight of the instrument throughout the belt. Both the extension and the belt itself are made fully adjustable by the use of an adhering fabric.

On the front of the support belt is an attachment plate, containing two sockets spaced to accommodate two attachment bolts. These sockets may be latched and unlatched easily allowing quick and smooth placement and removal of instruments.

The support plate contains two attachment bolts, one adjustable bolt and one stationary bolt. Once placed into their respective sockets, the stationary bolt serves as a pivot point, while the adjustable bolt allows limited movement about the axis of the stationary bolt.

The support plate may be backed with a non-abrasive padding so as not to mar the finish of the instrument when fastened in place by the use of screws or bolts.

These and other objects will become apparent from the following detailed description and drawings in which.

Figure 1:
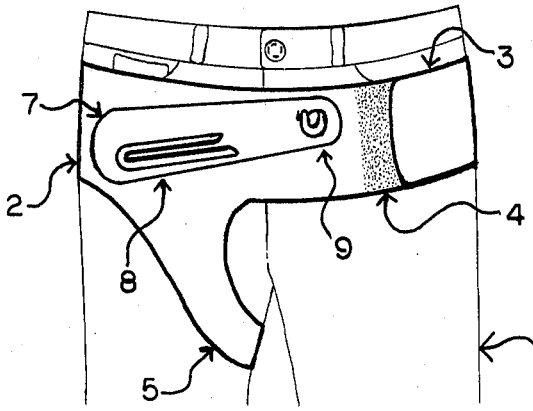
FIG. 1 is a front view of the support belt in use.
Figure 2:
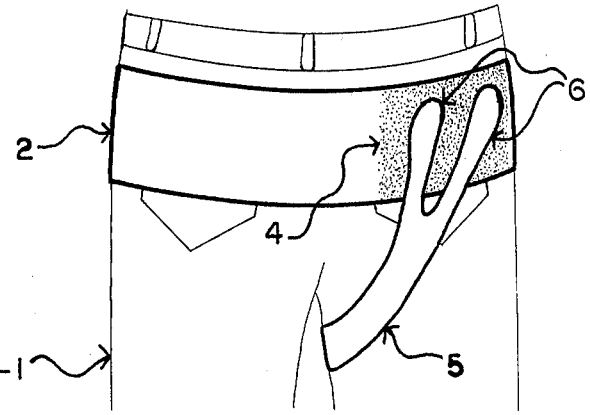
FIG. 2 is a back view of the support belt in use.
Figure 3:
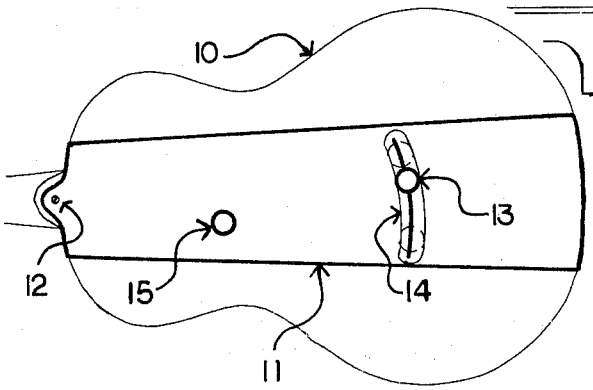
FIG. 3 is a rear elevational view of a support plate mounted on a hollow body guitar.
Figure 4:
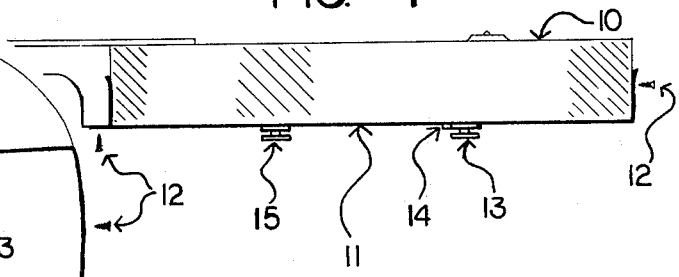
FIG. 4 is a top view of the support plate mounted on a hollow body guitar of a FIG. 3.
Figure 5:
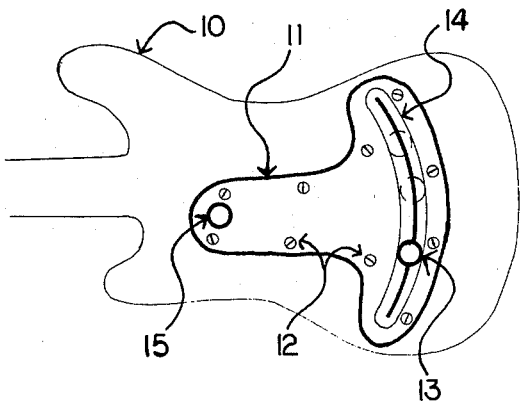
FIG. 5 is a rear elevational view of a support plate mounted on a solid body guitar.

Referring to the drawings, the player 1 is shown wearing a support belt 2. The belt end 3 is fastened by overlaying fields of an adhering fabric 4. This may be reinforced by more traditional types of fasteners such as buckles, if desired. The belt 2 is made more stable by an extension 5 passing along the inside area of one of the player's legs. This extension 5 is anchored to the rear of the support belt 2 by a pair of fingers 6 which are fastened by overlaying strips of adhering fabric 4.

Strategically placed on the front of the belt 2 is an attachment plate 7 containing two slotted sockets 8 and 9.

Figure 6:
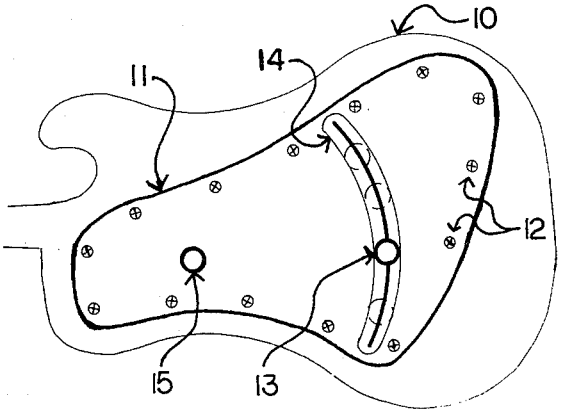
FIG. 6 is a rear elevational view of a support plate mounted on a solid body guitar, also serving as a cover plate.
Figure 7:
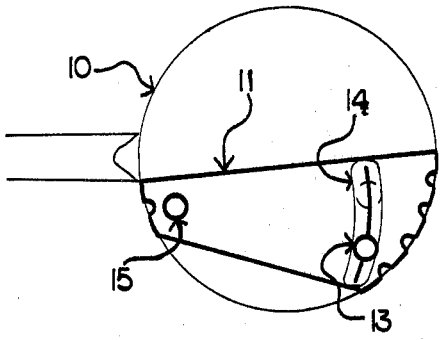
FIG. 7 is a rear elevational view of a support plate mounted on a banjo.
Figure 8:
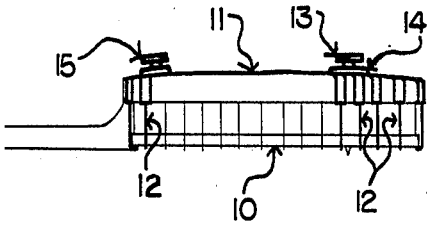
FIG. 8 is the bottom view of a support plate mounted on a banjo.
Figure 9:
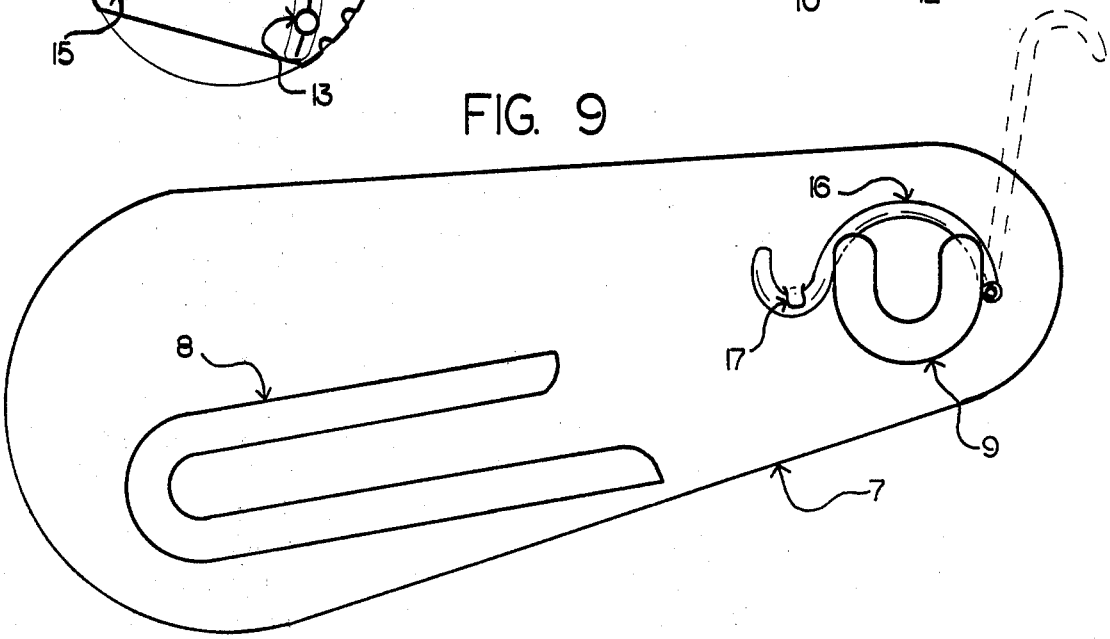
FIG. 9 is a front elevational view of an attachment plate on the belt.
Figure 10:
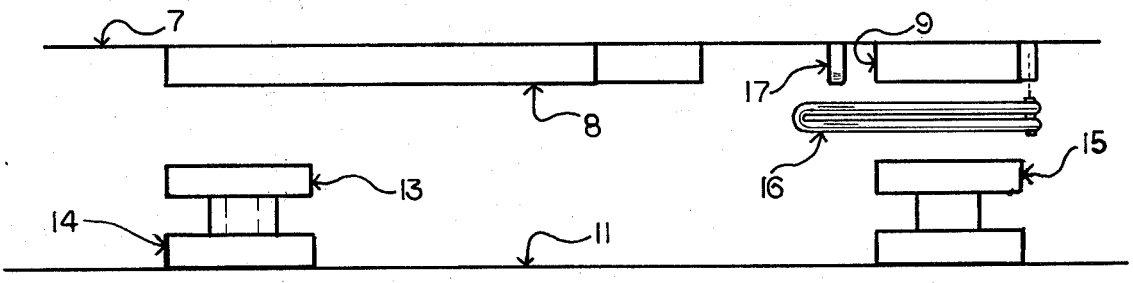
FIG. 10 is a top plan view of the attachment plate and the support plate.
Figure 11:
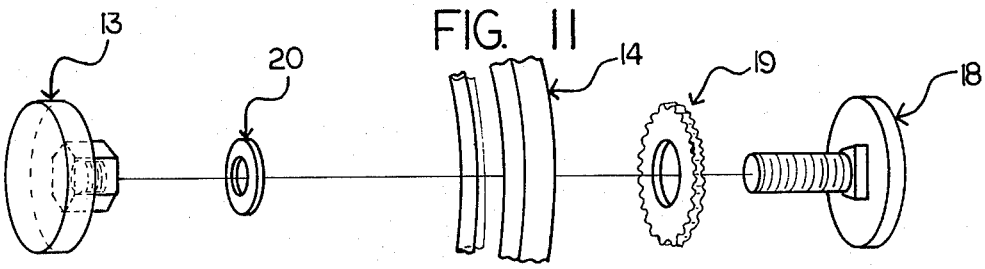
FIG. 11 is an exploded view of the adjustable attachment rod.

The stringed musical instruments 10 are shown in FIGS. 3–8 with support plates 11 in place. The support plates 11 are held in place upon the back of each instrument 10 by screws or bolts 12. FIG. 8 shows banjo rim bolts 12 also being used to secure support plate 11. FIG. 6 shows a support plate serving a second function as a cover plate.

The support plate contains two attachment bolts 13 and 15. The adjustable bolt 13 slides through adjusting slot 14 allowing limited vertical movement of the instrument 10 by the player 1. The stationary bolt 15 serves as a pivot point for the pivotal movement of the instrument 10. Adjustable bolt 13 may be tightened, if desired, restricting vertical movement through the adjusting slot 14.

The instrument 10 is held fast against the player 1 by attaching the support plate 11 to the attachment plate 7. This is done by first sliding the adjustable bolt 13 into the slot of elongated horizontal socket 8, and then placing the slot of the stationary bolt 15 into the vertical socket 9. Bolt 15 may be locked into place by placing the flexible securing loop 16 over the top of the slot in socket 9 and beneath a latch 17.

Once in place, the stationary bolt 15 will have a downward pull on socket 9 while the adjustable bolt 13 will have an upward pull on socket 8, resulting from the heavier weight of the instrument 10 to the side of the bolt 15 serving as the pivot point. This factor, along with the angle that the attachment plate 7 is set upon the belt 2, and the position of the extension 5 discourages twisting of the belt 2 while distributing the weight of the instrument 10 in both the front and back of the belt 2.

The adjustable bolt 13 is fastened to the anchoring bolt 18 which first passes through a locking washer 19, the adjusting slot 14, and an ordinary washer 20. If desired, pressure may be placed upon the locking washer 19 by turning bolt 13. This action will prevent movement of bolt 13 through slot 14, therefore preventing vertical movement of the instrument 10.

I claim:

1. Apparatus for supporting a stringed musical instrument having a main body comprising a band member adapted to be worn around the waist of the player; a support member adapted to be attached to the rear portion of the body of the musical instrument; and means at a pair of locations on said members for releasably coupling the support member to the bank member, said coupling means including a socket and a projecting element at each of said locations, respectively, each projecting element being removably received within the corresponding socket, the projecting element at one of the locations being shiftably mounted on one of the members for movement relative to the other projecting element to permit the support member to pivot relative to the band member about the other location.

2. Apparatus as set forth in claim 1, wherein each socket has an open end slot for removably receiving the corresponding projecting element.

3. Apparatus as set forth in claim 1, wherein the sockets are mounted on the band member and the projecting elements are on the support member.

4. Apparatus as set forth in claim 1, wherein said projecting element at said one location comprises a bolt capable of being releasably secured to said one member against movement relative to the other projecting element.

5. Apparatus as set forth in claim 1, wherein the band member has an extension secured to the front of the band member, said extension adapted to fit between the legs and around one leg and to extend upwardly to the back of the band member, and means on the band member for coupling the outer end of the extension to the rear of the band member.

6. Apparatus for supporting a stringed musical instrument having a main body comprising a band member adapted to be worn around the waist of the player; a support member adapted to be attached to the rear portion of the body of the musical instrument; and a socket and a projecting element at each of a pair of locations, respectively, on said members, each socket having an open end slot for removably receiving the corresponding projecting element for releasably coupling the support member to the band member, the slot of the socket at one of the locations being generally horizontal and the slot of the socket at the other location being generally vertical, the socket and projecting element at a first of the locations permitting the support member to pivot relative to the band member about the other location.

7. Apparatus for supporting a stringed musical instrument having a main body comprising a band member adapted to be worn around the waist of the player; a support member adapted to be attached to the rear portion of the body of the musical instrument; and a socket and a projecting element at each of a pair of locations, respectively, each projecting element being removably received within the corresponding socket, the sockets being mounted on the band member and the projecting elements being on the support member, each projecting element being removably received within the corresponding socket for releasably coupling the support member to the band member, one of the projecting elements being shiftably mounted on the support member for movement relative to the other projecting element about a generally horizontal axis when the musical instrument is in an operative position to be played.

8. Apparatus as set forth in claim 7, wherein said one projecting element comprises a bolt capable of being releasably secured to the support member against movement relative to the other projecting element.

* * * * *